US005294462A

United States Patent [19]

Kaiser et al.

[11] Patent Number: 5,294,462

[45] Date of Patent: Mar. 15, 1994

[54] ELECTRIC ARC SPRAY COATING WITH CORED WIRE

[75] Inventors: John J. Kaiser, Whitehall; Zbigniew Zurecki, Macungie; Kerry R. Berger, Lehighton; Robert B. Swan, Bath; Edward A. Hayduk, Jr., Blandon, all of Pa.

[73] Assignee: Air Products and Chemicals, Inc., Allentown, Pa.

[21] Appl. No.: 974,034

[22] Filed: Nov. 12, 1992

Related U.S. Application Data

[62] Division of Ser. No. 611,199, Nov. 8, 1990, abandoned.

[51] Int. Cl.[5] ..... B05P 1/08

[52] U.S. Cl. ..... 427/446; 427/449; 427/451; 427/453; 427/456

[58] Field of Search ..... 427/446, 449, 451, 453, 427/456

[56] References Cited

U.S. PATENT DOCUMENTS

| | | | |
|---|---|---|---|
| 2,785,285 | 3/1957 | Bernard | 427/446 |
| 3,140,380 | 7/1964 | Jensen | 427/446 |
| 3,375,127 | 3/1968 | Mellor | 427/446 |
| 3,630,770 | 12/1971 | Favreau | 427/446 |
| 3,632,952 | 1/1972 | Rotolico et al. | 219/76 |
| 3,834,880 | 9/1974 | Vessey | 29/191.2 |
| 4,173,685 | 11/1979 | Weatherly | 428/556 |
| 4,228,223 | 10/1980 | Knotek et al. | 428/558 |
| 4,256,490 | 3/1981 | Zaets et al. | 106/1.12 |
| 4,519,840 | 5/1985 | Jackson et al. | 106/1.05 |
| 4,526,618 | 7/1985 | Keshavan et al. | 106/1.05 |
| 4,741,974 | 5/1988 | Longo et al. | 428/558 |
| 4,810,850 | 3/1989 | Tenkula et al. | 219/146.1 |
| 5,019,454 | 5/1991 | Busse | 428/570 |

OTHER PUBLICATIONS

Drzeniek et al.; "Introduction of Cored Wires to Arc Spraying"; Proceedings, 10th Int'l. Thermal Spray, Conf.; May 2-6, 1983; Essen, W. Germany.

Steffens et al.; "Arc Spraying of Steel and Cored Wires"; Adv. in Thermal Spray. Proc. 11th Int'l. Conf.; Sep. 8-12, 1986; Montreal.

Pokhmurskii, V. I.; "Fundamentals of the Formation of Protective & Repair Coatings by Electric Arc Spraying of Powder Wires".

Drzeniek et al.; "Cored Tube Wires For Arc and Flame Spraying"; Proc. Nat.'l Thermal Spray Conf.; Sep. 14-17, 1987.

Cobb et al.; "Hard Surface Coatings by Electric Arc Spraying"; *Welding & Metal Fabrication*; vol. 56; (5); p. 226, Jul. 1988.

Steffens et al.; "Influence of Rare Earth Elements On Properties of Electric-Arc Sprayed Coatings Using Cored Wires" pp. 325-330.

Steffens et al.; "Wear Resistant Composite Coatings Produced By Arc Spraying Using Cored Wires"; pp. 331-336.

*Primary Examiner*—Donald P. Walsh
*Assistant Examiner*—Daniel Jenkins
*Attorney, Agent, or Firm*—John M. Fernbacher; James C. Simmons; William F. Marsh

[57] ABSTRACT

A method is disclosed for the electric arc spraying of powder-filled cored wires to apply hard, wear-resistant coatings to various substrates. Inert gas, preferably nitrogen, is supplied to the arc spray gun such that the mass ratio of the wire feed rate to the gas feed rate is preferably between about 0.07 and about 0.11. Operation in this range yields an optimum combination of coating hardness properties and arc spray gun operating characteristics.

15 Claims, 2 Drawing Sheets

ELECTRIC ARC SPRAY COATING WITH CORED WIRE

This is a division of application Ser. No. 07/611,199 filed on Nov. 8, 1990 now abandoned.

FIELD OF THE INVENTION

The present invention pertains to the electric arc spray coating of substrates, and in particular to the electric arc spraying of powder-filled cored wire.

BACKGROUND OF THE INVENTION

Thermal spray processes are used to apply corrosion-resistant and wear-resistant coatings to a wide variety of substrates and articles. Four types of thermal processes are used for different types of materials and applications: flame spraying, plasma spraying, detonation spraying, and electric arc spraying. Of these processes, electric arc spraying is preferred in many applications for its high deposition rates and economical operation.

The development of coating applications using the electric arc spray process to produce hard, wear-resistant coatings using cored wires which contain powdered metal or ceramic/metal components in a metal sheath has been initiated over the past several years. In the spraying process, usually carried out in a surrounding air atmosphere with compressed air as the atomizing gas, alloys and/or composites are formed between the sheath and core materials and are deposited on the substrate to form hard, wear-resistant coatings. Core powder materials can be selected from a variety of elements and compounds including combinations such as tungsten carbide-cobalt, nickel-chromium-boron, nickel-iron, boron carbide-iron-molybdenum, and chromium-boron-silicon. Likewise, sheath materials can be selected from a range of alloys comprising iron, nickel, and other elements. The use of cored wires allows the application of powdered components by the efficient and economical arc spray process; powdered components otherwise must be applied by the flame, detonation, or plasma spray methods.

The production of cored wires for arc spraying is discussed in a paper by H. Drzeniek et al in *Proceedings, 10th International Thermal Spraying Conference,* Essen, W. Germany, May 2–6, 1983, at p.136. Various cross-section types of iron wire filled with nickel powder are disclosed and the effect of spray parameters on coating properties are described.

U.S. Pat. No. 4,741,974 discloses a composite wire for use in arc gun spraying formed of an alloy sheath comprising iron, nickel, or cobalt, and a core comprising boron-containing powder of boron, boron carbide, and/or a ferromolybdenum alloy powder. Coatings are formed with such wire using a standard arc spray gun using air at 60 psia for atomizing and 40 psia for air cap.

An article by H.-D. Steffens et al in *Advances in Thermal Spraying,* Proceedings of the 11th International Thermal Spraying Conference, Montreal, Sep. 8–12, 1986, at p.457 discloses the arc spraying of cored wire using a methane-air mixture to atomize the molten metal. The use of methane in this mixture reduces problems with burnoff (oxidation) of the powder material when air alone is used as the propelling gas. The article cites earlier work in which argon and hydrogen-nitrogen mixtures were used in an attempt to eliminate burnoff problems associated with the use of air as the propelling gas. It is stated that this approach was relatively ineffectual, and that the trend has been towards arc spraying using low pressure chambers or chambers filled with inert gases.

V. I. Pokhmurskii et al in *Fiziko-Khimicheskaya Mekhanika Materialov,* Vol. 22, No. 6, Nov.-Dec. 1986 at p.11 discuss the arc spray coating of powder-filled wires in which aluminum powder is added to reduce the oxidation losses of iron and titanium which occur when air is used as the propelling gas.

Arc spraying of cored wires containing powder comprising carbon, manganese, silicon, chromium, and titanium carbide is disclosed in U.S. Pat. No. 4,810,850 wherein the particle size of the core powder is controlled at between 20–300 microns. The control of the powder particle size is described as important to prevent burnoff of the particles, a condition which decreases the efficiency of the arc spray process and lowers the amount of alloying elements in the coating.

S. J. Harris et al in an article in *Surface Engineering,* Proceedings of the 2nd International Conference, Stratford-upon-Avon, UK, Jun. 16–18, 1987 at p.447 describe the arc spraying of a low carbon steel wire filled with a tungsten carbide-cobalt powder and a nickel wire filled with nickel-boron and high carbon ferrochrome powder. The arc spray gun is operated using compressed air as the atomizing gas.

The arc spraying of cored wires using air-methane mixtures for atomization is further described by H. Drzeniek and H.-D. Steffans in a paper in *Proceedings of the National Thermal Spray Conference,* Orlando, Fla., Sep. 14–17, 1987 at p.33. It is stated that since the atomizing gas is preferably air, the interaction of metal with air and the oxidation reactions therebetween are significant. The addition of methane to the atomization air reduces metal oxidation and thereby improves the coating properties compared with the use of air alone.

An overview of thermal spray coating methods and a description of electric arc spray coating using cored wires containing tungsten carbide-cobalt and nickel-chromium-boron powders are given R. C. Cobb et al in an article in *Welding and Metal Fabrication,* Vol.56, No.5, July 1988 at p.226. Air and inert gas are disclosed as potential atomizing gases, although air is preferred for actual applications.

The use of rare earth elements in cored wires used for electric arc spray coating applications is disclosed by H.-D. Steffans et al in *Proceedings of the National Thermal Spray Conference,* Oct. 24–27, 1988, Cincinnati, Ohio at p.325. It is pointed out that electric arc spraying of cored wires using air causes oxidation of particles during flight and after impact with the substrate, leading to reduction of adhesion of the coating. The use of unidentified rare earth alloys as powders in a low carbon steel sheath containing iron powder, when the cored wire is arc sprayed with air, gives increasing tensile and compressive strength of the coatings at increasing levels of the rare earth alloys up to 0.9 wt % in the core powder.

H.-D. Steffans et al in *Proceedings of the National Thermal Spray Conference,* Oct, 24–27, 1988, Cincinnati, Ohio at p.325. disclose the arc spraying of cored wires made from low carbon steel sheaths containing ferrochrome or chrome carbide powders to which carbides or borides are added in varying amounts. Spraying in an air atmosphere causes a loss of carbon and/or boron, but the authors teach that the content of carbon and boron in the coating can be controlled and oxidation reduced by adding additional carbon and/or deoxidizers such as phosphorous to the core filler material.

The background art discloses the desirability of electric arc spray coating using cored wires, and also discloses that the use of air as the preferred atomizing gas can cause oxidation of metal components during spraying and thus reduce the overall effectiveness of the coating process. Methods to reduce such oxidation losses have been disclosed, specifically the addition of deoxidizers to the core powder and the addition of methane to the atomizing air. Control of powder particle size is also a potential approach to control metal oxidation. The earlier attempt to use argon and hydrogen-nitrogen mixtures to reduce metal oxidation when arc spraying in a surrounding air atmosphere has been noted in the background art; this attempt was relatively ineffective, and led to the use of low pressure chambers or chambers filled with inert gases in which arc spraying is carried out.

Electric arc spraying for the application of wear-resistant coatings has important economic and operational advantages over other thermal spray coating methods, and therefore is expected to find increasing use in the future. Accordingly, there is a need for improving the effectiveness of electric arc spraying of cored wires for the application of high-quality, wear-resistant coatings. The invention described in the following disclosure and claims is directed towards such an improvement.

SUMMARY OF THE INVENTION

The present invention is a method for applying a metallic coating to a substrate by the arc spraying of cored wire. The method comprises forming an electric arc between two metallic wires in an arc spray gun, wherein at least one of the wires is a cored wire comprising a powder-filled metallic sheath, thereby forming molten material. Inert gas is directed across the arc to form molten droplets and propel the droplets onto the substrate to solidify and form the metallic coating, and the mass ratio of the wire feed rate to the inert gas feed rate is between about 0.055 and about 0.15. The inert gas can be nitrogen, argon, or mixtures thereof. The invention is also a coated substrate comprising a substrate and a metallic coating on at least one surface thereof, in which the metallic coating is formed by this method. Preferably, the mass ratio of the wire feed rate to the inert gas feed rate is between about 0.07 and about 0.11, and the use of inert gas in this range of mass ratios optimizes the hardness characteristics of the metallic coating and the operating characteristics of the arc spray gun.

DETAILED DESCRIPTION OF THE INVENTION

Figure 1:
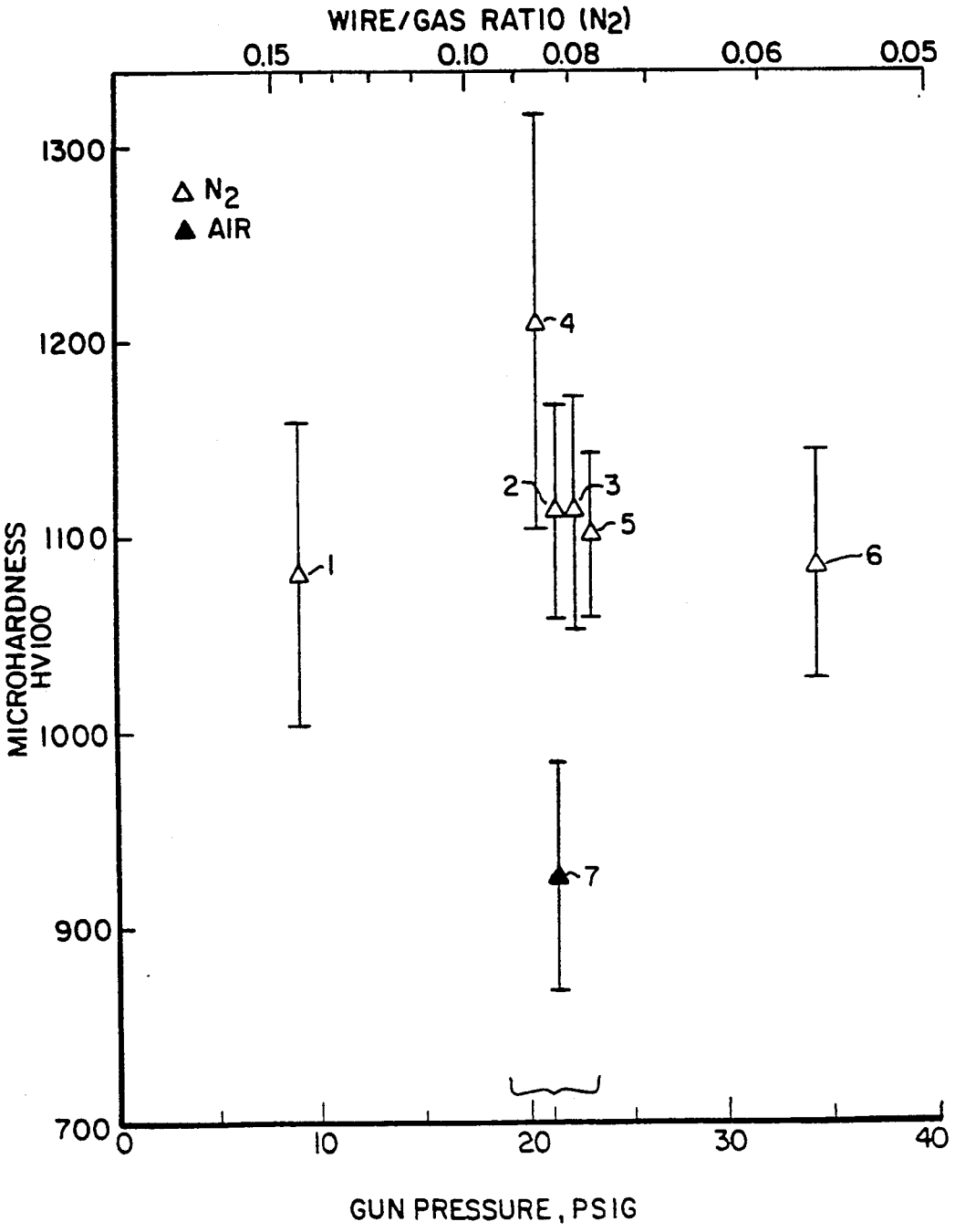
FIG. 1 is a graph of coating microhardness (HV100) vs wire/gas ratio and gun pressure of arc-sprayed coatings using air and nitrogen.

The present invention provides an improved method for applying hard, wear-resistant coatings to substrates in a surrounding air atmosphere by the use of powder-filled cored wires in an electric arc spray gun in which the propelling or atomizing gas is nitrogen, argon, or a mixture thereof. It has been found in particular that the use of nitrogen for atomization in the spray gun in a selected range of wire/gas ratio, when compared with air which is taught as the preferred gas in most of the earlier-described background art, results in harder, more uniform coatings and allows more efficient deposition in the application thereof. The use of nitrogen reduces the oxidation of metal components during spraying, thus yielding fewer undesirable metal oxides in the final coating. In addition, the use of nitrogen reduces the formation of fumes and fugitive dust during spraying, which in turn yields cleaner operation and reduced losses of cored wire components as compared with air atomization.

It has been found unexpectedly that the microstructure of certain coatings is different when the coatings are applied with nitrogen atomization than with air atomization. Experimental tests later described on the arc spraying of cored wires containing iron and chromium with small amounts of boron, silicon, and carbon demonstrated that a higher amount of a desirable amorphous solid phase is formed when nitrogen rather than air is used for atomization. It also has been found unexpectedly that, compared with the use of air at equivalent operating conditions, the use of nitrogen gives faster droplet quenching, which is desirable in minimizing oxidation and in forming metal microstructure with better hardness characteristics.

The operation of an arc spray gun according to the present invention is similar in certain respects to the operation of arc spray guns as is known in the thermal spray coating art. Any type of commercially-available arc spray gun can be used, and a wide variety of commercially-available powder-filled cored wires can be fed through an arc gun using known feed mechanisms. In the operation of the arc spray gun, two electrically conductive wires, at least one of which is a cored wire, are advanced through wire positioners within the gun and come into close proximity at the tip of the gun, where an arc is struck across the wires. The arc causes the wires to melt, and a stream of compressed gas, in particular inert gas, is directed at the molten metal whereby the molten metal is atomized and carried to the substrate surface where it solidifies to form a metal coating. In the present invention, the inert gas is nitrogen, argon, or a mixture thereof. Conditions for gun operation are set by selecting the arc voltage, wire diameter, atomizing gas supply pressure, nozzle size, standoff distance (the distance from the gun tip to the substrate being coated), and the current supply to the gun. The wire feed rate then is controlled to yield the selected value of the gun current. Alternately, the wire feed rate can be selected such that the gun current is in the desired range. The speed, direction, and number of passes of the gun over the substrate are generally chosen by experience to give the desired coating thickness and localized deposition rate on the substrate.

The distinguishing feature of the present invention is the use of nitrogen, argon, or mixtures thereof as the atomizing gas, such that the mass ratio of the wire feed rate to the gas feed rate is between about 0.055 and 0.15, and preferably between 0.07 and about 0.11. This mass ratio also is designated herein as the wire/gas ratio. When a gun nozzle orifice diameter of 0.37 inches is used, the atomizing gas pressure in the internal chamber of the spray gun upstream of the wire positioners (defined herein as the gun pressure) is preferably between about 14 and about 26 psig. Nozzle orifice diameters between about 0.2 and about 0.5 inches can be used. The gun is operated at a potential of between about 36 and about 40 volts, a current of between about 150 and about 250 amperes, and a standoff distance of between about 3 and 6 inches. Operation of the spray gun at these conditions, particularly at a wire/gas ratio between about 0.07 and about 0.11, optimizes the hardness characteristics of the coating, the operational performance of the arc spray gun, and the uniformity of the coating.

The invention can be used for the arc spraying of a wide range of cored wire materials. The powder components in the wire core typically can be selected from cobalt, nickel, chromium, boron, iron, molybdenum, copper, manganese, carbon, silicon, phosphorous, aluminum, tungsten carbide, boron carbide, and alloys or mixtures thereof. Other metal or ceramic powders suitable for forming mixtures or alloys with the sheath materials can be used to deposit coatings of specific composition and properties. The sheath is typically steel or stainless steel, but can be made of other metals as required to yield suitable alloys or mixtures with the core powder materials. The material of the sheath can be selected from iron, nickel, aluminum, and mixtures or alloys thereof. A typical wire diameter of 1/16 inch ±25% is used, but other wire diameters can be used depending upon the properties of the metals in the wire and the specific gun operating parameters. The metallic coating deposited on the substrate by the process of the present invention is at least partly amorphous, and a typical coating can contain 20–50 wt % chromium, 1–4 wt % boron, 0–2 wt % silicon, 0–0.8 wt % carbon, 0–1.0 wt % oxygen, and 0–1.0 wt % nitrogen, and the balance iron. The coating also can contain 0–20 wt % nickel, 0–10 wt % molybdenum, 0–5 wt % manganese, and 0–5 wt % copper. The coating can be applied to a wide variety of metal or ceramic substrates.

Experimental arc spraying tests over a range of operating conditions and analyses of the resulting coatings were carried out as described in detail in the Examples given below. In a first series of tests, cored wire comprising a stainless steel sheath filled with a powder containing iron, chromium, and minor amounts of carbon, boron, and silicon was applied to steel test coupons using a commercially-available arc spray gun with nitrogen as the atomizing gas. Chemical analyses, metallographic testing, and hardness testing were done on each of the coated coupons. In addition, inspection and metallographic analyses were done on the solidified wire tips after spraying was discontinued. Initial results indicated that the preferred mode of molten droplet formation and spray gun operation occur within the ranges of potential (voltage), current, and standoff distance for the present invention as described above, namely, 30–40 volts, 150–250 amperes, and 3–6 inches respectively. After these conditions were established, the effects of wire/gas ratio (and the corresponding atomizing gas gun pressure) on gun performance and coating properties were studied to determine the optimum operating range for the process. It was found that coating hardness parameters, operational performance of the spray gun, and uniformity of the coating each are affected differently by the wire/gas ratio (and the corresponding gun pressure), and that the optimum range of wire/gas ratio of the present invention is therefore defined by the best acceptable combination of these variables.

The effects of wire/gas ratio and the corresponding atomizing gas pressure on coating hardness were determined in a series of experimental tests as described in detail in the Examples given below. In the tests, cored wire comprising a stainless steel sheath filled with a powder containing iron, chromium, and minor amounts of carbon, boron, and silicon was arc sprayed on steel test coupons using nitrogen as the atomizing gas with a nozzle orifice diameter of 0.37 inch. The coupons were coated at wire/gas ratios of 0.056, 0.080, and 0.141 (gun pressures of 9, 21, and 34 psig) and measurements on the resulting coatings were obtained for microhardness (Vickers HV100) and macrohardness (Rockwell Superficial Hardness 30N). Results indicated that microhardness (HV100) is a maximum at a wire/gas ratio of 0.080, while the macrohardness (30N) increases with decreasing wire/gas ratio.

In order to determine the effect of gun pressure on wire melting and droplet formation mechanisms, tests were made at constant current and voltage using nitrogen at wire/gas ratios of 0.056, 0.080, and 0.141 (gun pressures of 9, 21, and 34 psig). After each test, the solidified wire tips were microscopically and metallographically inspected to yield the following observations and conclusions:

1) At the wire/gas ratio of 0.141 (gun pressure of 9 psig), large molten areas were formed which exhibit good mutual alloying of sheath and core material, but molten droplets apparently were not easily detached and this resulted in the observed welding of the wire tips and unstable arc formation. This in turn led to a nonuniform coating with inferior hardness characteristics as determined from measurements earlier described.
2) At the wire/gas ratio of 0.080 (gun pressure of 34 psig), mutual alloying of the sheath and core materials did not occur uniformly because, it is believed, the high gas velocity apparently prevented enough time for droplet growth and uniform dissolution of all materials at the wire tip. Very fine droplets apparently were quickly detached, but since these droplets were not uniform in composition, the resulting coating was not uniform in hardness and chemical properties.
3) Overheating of the wire tips occurred at the wire/gas ratio of 0.141 (gun pressure of 9 psig) because droplets apparently grew larger and detached at a low rate. It is believed that a partial melting and fragmentation of solid pieces from the wire tips occurred because an excessive detachment rate of droplets decreased the amount of melting and allowed the electric arc to fracture the sheath material. Arc spitting, which is an undesirable irregularity in arcing and wire melting which results in detachment of pieces of unmelted wire material, was observed during operation at the wire/gas ratio of 0.056 (34 psig gun pressure).
4) Large austenite grain size in solidified sheath material was observed at the wire/gas ratios of 0.141 and 0.056 (gun pressures of 9 and 34 psig), indicating localized prolonged overheating and absence of desired melting, with a more desirable smaller and uniform grain size occurring at the wire/gas ratio of 0.080 (21 psig gun pressure). This indicated that heat from the arc is properly directed in droplet formation at the wire/gas ratio of 0.080 (21 psig gun pressure) but not at wire/gas ratios of 0.141 and 0.056 (9 and 34 psig gun pressure).

Based upon these hardness measurements and operating observations, it was concluded that, of the three sets of conditions tested, the wire/gas ratio of 0.080 (corresponding gun pressure of 21 psig) gave the optimum combination of hardness characteristics and acceptable spray gun operation performance. While the macrohardness (30N) increased as wire/gas ratio was decreased, the gun operating characteristics at the lowest wire/gas ratio are generally less favorable than at 0.080. In addition, microhardness (HV100) was greater at 0.080 than at the higher or lower wire/gas ratios. Based on analysis of the data at the three ratios, it was concluded that arc spray gun should be operated between wire/gas ratios of about 0.07 and about 0.11 for optimum results.

In a second series of spraying tests, air was used as the atomizing gas at a gun pressure of 21 psig (wire/gas ratio of 0.071) using the same wire, gun, and operating parameters as used for comparable nitrogen spraying tests. Hardness measurements were made on the air-sprayed coating and compared with the nitrogen-sprayed hardness data. Results showed that the nitrogen-sprayed coatings exhibited generally higher macrohardness (30N) values and significantly higher microhardness (HV100) values than the air-sprayed coatings.

The air-sprayed and nitrogen-sprayed coatings were also analyzed by X-ray diffraction to determine the type of crystal microstructure exhibited by the major iron-rich phase in the coating. Results showed unexpectedly that the nitrogen-sprayed coating exhibited a higher fraction of amorphous microstructure in the major iron-rich phase than that exhibited by the air-sprayed coating. This is desirable because amorphous iron alloys possess much better wear resistance than alloys with a crystalline microstructure. While it is not fully understood why the nitrogen-sprayed coating has a higher fraction of amorphous microstructure, it is believed that the higher rate of cooling or quenching of nitrogen-sprayed molten droplets in transit from the spray gun to the coating surface and on the coating surface is a major factor, with higher rates of cooling being more desirable. Temperature measurements of the metal substrates during both air and nitrogen spraying confirmed that in fact the cooling or quenching rate is higher when nitrogen is used than when air is used at equivalent gun operating conditions. This phenomenon was unexpected and is not predictable from the arc spraying background art. The reasons for the different droplet quenching effects of nitrogen and air are not understood, but apparently depend upon differences between nitrogen and air in electrical properties, ionization potential, heat transfer characteristics, density/momentum transfer during droplet detachment, formation of oxide or nitride films on the wire tips, and evaporation of metal components in the arc.

The chemical compositions of the air-sprayed and nitrogen-sprayed coatings were determined by elemental analysis in order to understand other aspects of the spray coating process. As indicated in detail in the Examples below, there was a significantly higher concentration of carbon and a significantly lower concentration of oxygen in the nitrogen-sprayed coating than in the air-sprayed coating, both of which are desirable trends in forming hard, wear-resistant coatings. It was also found, unexpectedly, that nitrogen was present at significantly higher levels in the air-sprayed coating than in the nitrogen-sprayed coating. The iron content of the nitrogen-sprayed coating was higher than the iron content in the air-sprayed coating, and, by comparison with the iron content of the cored wire, confirmed the observation that iron loss as fumes and dust during air spraying was significant while for nitrogen spraying there was essentially no loss of iron.

The use of nitrogen for atomization in the arc spraying of cored wires using wire/gas ratios in the range of about 0.055 and 0.15, and preferably between about 0.07 to about 0.11, thus gives improved performance of the arc spray process compared with the use of compressed air for atomization. The use of argon or nitrogen-argon mixtures also can be utilized for atomization in this range of pressures. The selection of this range of wire/gas ratios in the present invention between about 0.07 to about 0.11 optimizes important process and coating parameters, and the dependence of these parameters on wire/gas ratio and gun pressure is not predictable from the earlier-cited background art. The use of the present invention for the arc spraying of cored wire therefore yields coatings having superior hardness characteristics than air-sprayed coatings, and allows higher coating efficiencies and improved operability over air-atomized arc spraying.

The following Examples illustrate the features of the present invention and support the disclosure of the invention presented above.

EXAMPLE 1

Steel coupons measuring 3 by 4 inches were prepared by conventional grit blasting and were coated using a TAFA Model 8830 arc spray gun supplied by TAFA, Inc. of Concord, N.H. The gun was fitted with a nozzle having a 0.37 inch diameter orifice and was operated at a traverse speed of 300 inches per minute. Armacor M cored wire, supplied by Amorphous Metals Technologies, Inc. of Irvine, Calif., was used in the spray gun for all test runs. Armacor M is a cored wire having a sheath of 18-8 austenitic stainless steel filled with a powder comprising chromium and iron with minor amounts of carbon, boron, and silicon. The wire as received was analyzed by inductively coupled plasma spectroscopy and a LECO analyzer and had an overall composition (in wt %) of 67.6% iron, 30.12% chromium, 0.098% carbon, 0.024% nitrogen, 0.11% oxygen, 1.24% boron, and 0.78% silicon. Coatings were applied to the coupons using a number of spraying conditions in the range of 100–300 amperes current, potentials of 30–40 volts, standoff distance of 3–6 inches, and nitrogen or air supply pressures as measured at the arc spray system control panel of 30, 60, and 90 psig. The corresponding nitrogen and air pressures in the internal chamber of the spray gun upstream of the wire positioners with the wires extended in the operating position (defined as gun pressure) were determined to be 9, 21, and 34 psig respectively, and the wire/gas ratios were determined to be 0.141, 0.080, and 0.056 respectively for nitrogen and 0.124, 0.071, and 0.049 respectively for air. After a number of initial tests, a potential of 36 volts was selected for a final series of coating tests in which current, standoff distance, and nitrogen pressure were varied. For comparison purposes, a coupon was coated using air as the atomizing gas at a gun pressure of 21 psig.

Figure 2:
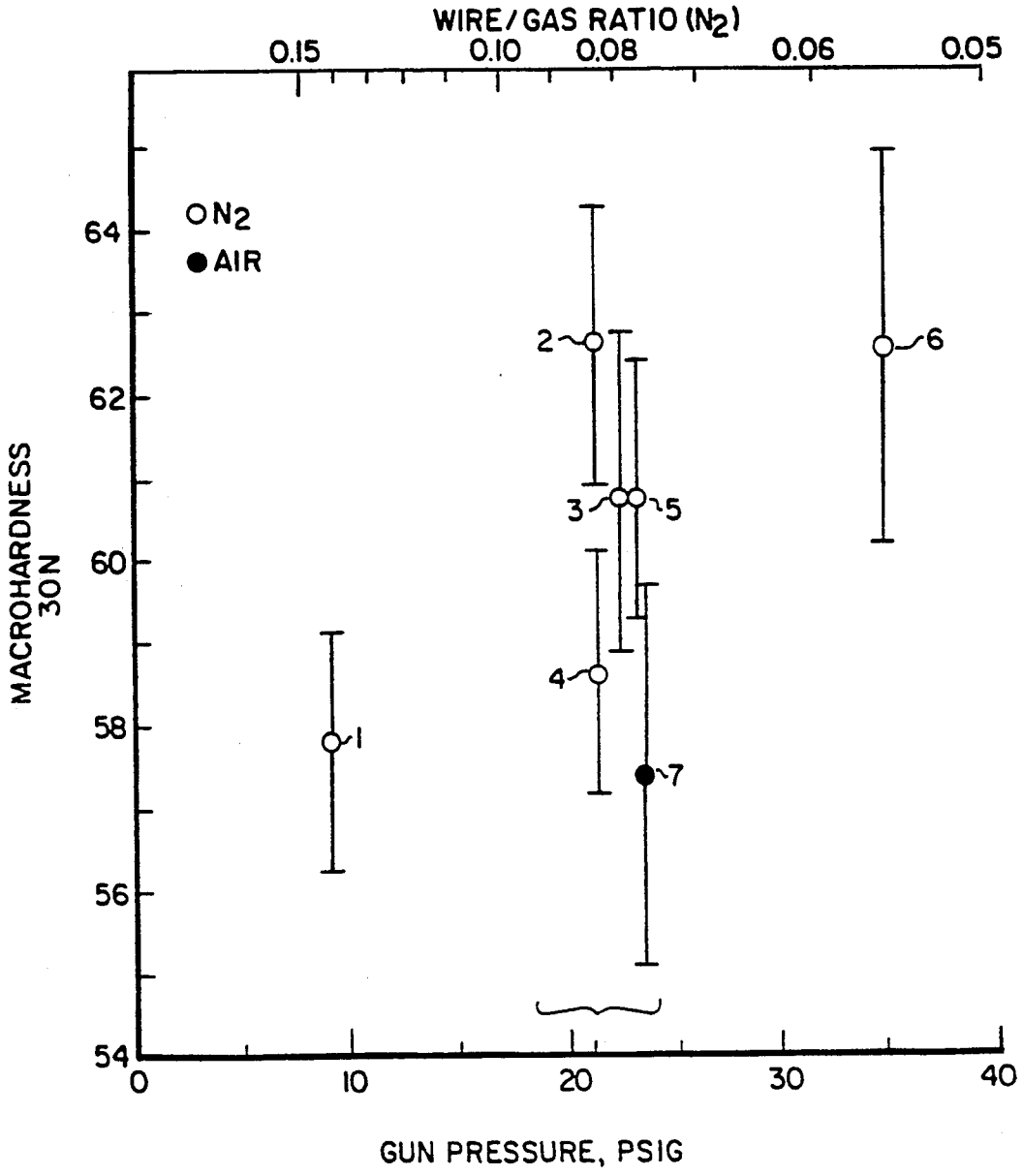
FIG. 2 is a graph of coating macrohardness (30N) vs wire/gas ratio and gun pressure of arc-sprayed coatings using air and nitrogen.

Coated coupons from the final series of coating tests were prepared for hardness testing. The top surface of each coupon as sprayed was tested for macrohardness (Rockwell Superficial Hardness 30N) using the American Society for Testing and Materials (ASTM) Method E92-82. Metallographic cross-sections of the coupons were tested for microhardness (Vickers Microhardness HV100) using the American Society for Testing and Materials (ASTM) Methods E18-84 and E140-86. Each hardness test was repeated at least seven times on each coupon, and a mean hardness value and corresponding standard deviation (95% confidence level) were calculated for each set of determinations for each coupon. The resulting data are given in Table 1 for the seven key test coupons. Mean microhardness values and the standard deviation for each mean value are shown in FIG. 1 as a function of gun pressure (for air and $N_2$) and wire/gas ratio (for $N_2$), and the corresponding macrohardness values and standard deviations are shown in FIG. 2. The run numbers beside each point correspond to those given in Table 1. Because five separate mean hardness determinations were made at a gun pressure of 21 psig (wire/gas ratio of 0.080 for $N_2$), the points as plotted in FIGS. 1 and 2 are slightly separated on the horizontal axis for clarity. These data indicate, as discussed earlier, that at the gun pressure of 21 psig the nitrogen-sprayed coatings are higher in both microhardness and macrohardness than the air-sprayed coatings. The data also indicate that for nitrogen-sprayed coatings the microhardness is a maximum at a wire/gas ratio of about 0.080, while the macrohardness increases as the wire/gas ratio is decreased over the range tested.

TABLE 1

HARDNESS MEASUREMENTS FOR $N_2$ AND AIR SPRAYING COATINGS

| Run No. | Gas | Current, Amperes | Gas Pressure, psig | Wire to Gas Ratio | Standoff Distance, inches | Macrohardness (30N) Mean Value | Macrohardness (30N) Standard Deviation (95%) | Microhardness (HV100) Mean Value | Microhardness (HV100) Standard Deviation (95%) |
|---|---|---|---|---|---|---|---|---|---|
| 1 | $N_2$ | 200 | 9 | 0.141 | 6 | 57.8 | 1.6 | 1082 | 78 |
| 2 | $N_2$ | 200 | 21 | 0.080 | 3 | 62.6 | 1.7 | 1112 | 54 |
| 3 | $N_2$ | 100 | 21 | — | 6 | 60.8 | 1.9 | 1112 | 59 |
| 4 | $N_2$ | 200 | 21 | 0.080 | 6 | 58.6 | 1.5 | 1209 | 106 |
| 5 | $N_2$ | 300 | 21 | — | 6 | 60.8 | 1.6 | 1101 | 43 |
| 6 | $N_2$ | 200 | 34 | 0.056 | 6 | 62.4 | 2.4 | 1087 | 59 |
| 7 | Air | 200 | 21 | 0.071 | 6 | 57.4 | 2.3 | 926 | 60 |

EXAMPLE 2

Nitrogen-sprayed and air-sprayed coupons as prepared in Example 1 using gun parameters of 200 amperes current, 36 volts potential, 6 inches standoff distance, and 21 psig gun pressure were subjected to elemental analysis by inductively coupled plasma spectroscopy and a LECO analyzer. The cored wire was also analyzed by the same method. The results are given in Table 2 and support the conclusions discussed earlier, namely, that there was a significantly higher concentration of carbon and a significantly lower concentration of oxygen in the nitrogen-sprayed coating than in the air-sprayed coating, both of which are desirable trends in forming hard, wear-resistant coatings. It was also found, unexpectedly, that nitrogen was present at significantly higher levels in the air-sprayed coating than in the nitrogen-sprayed coating. The iron content of the nitrogen-sprayed coating was higher than the iron content in the air-sprayed coating, and, by comparison with the iron content of the cored wire, confirmed the observation that iron loss as fumes and dust during air spraying was significant while for nitrogen spraying there was essentially no loss of iron.

TABLE 2

Elemental Analysis of Coatings and Cored Wire (Wt %)

| Component | Cored Wire | $N_2$-Sprayed Coating | Air-Sprayed Coating |
|---|---|---|---|
| Carbon | 0.098 | 0.048 | 0.027 |
| Nitrogen | 0.024 | 0.160 | 0.240 |
| Oxygen | 0.11 | 0.22 | 1.12 |

TABLE 2-continued

Elemental Analysis of Coatings and Cored Wire (Wt %)

| Component | Cored Wire | $N_2$-Sprayed Coating | Air-Sprayed Coating |
|---|---|---|---|
| Chromium | 30.12 | 29.99 | 31.62 |
| Boron | 1.24 | 1.23 | 2.62 |
| Silicon | 0.78 | 0.62 | 0.57 |
| Iron | 67.6 | 67.7 | 63.8 |

EXAMPLE 3

The coupons of Example 2 were analyzed by X-ray diffraction to determine the type of crystal microstructure exhibited by the major iron-rich phase in the coating. All analyses were done using a Siemens D-500 diffractometer. Coated coupons having a coating thickness of 15–20 mil were scanned to conventional theta/two-theta reflection diffraction which analyzed the top 3–4 microns of the surface and also by grazing incidence diffraction which analyzed the surface to a depth of about 0.7 microns. The uncoated sides of each coupon were similarly scanned for reference purposes, as normal uncoated steel is known to have 100% microcrystalline iron phases.

Conventional theta/two-theta step scans were done using Cu radiation with 1 degree slits, a 0.02 degree step size, 1.0 sec count time per step (0.5 sec for the uncoated side). Scans were done from 10–120 degrees two-theta. Grazing incidence diffraction scans were done with incident X-rays fixed at a 4 degree angle to the sample surface throughout the test. Scans were typically from 40–48 degrees two-theta to include the Fe (110) peak near 45 degrees. The degrees of crystallinity were then determined by comparing the normalized intensities (areas) under the Fe (110) peaks in the coated vs uncoated sides of each coupon.

The results are given in Table 3 and show that the nitrogen-sprayed coating exhibited a higher fraction of amorphous microstructure in the major iron-rich phase than that of the air-sprayed coating.

TABLE 3

Coating Microstructure Analyses of Arc-Sprayed Coatings by X-ray Diffraction

| Atomization Gas | Relative % Amorphous Microstructure: Reflection Diffraction | Relative % Amorphous Microstructure: Grazing Incidence Diffraction |
|---|---|---|
| Air | 80.2 | 82.1 |
| Nitrogen | 87.3 | 88.5 |

EXAMPLE 4

At the conclusion of several arc spraying tests described in Example 1, namely for wire/gas ratios of 0.141, 0.080, and 0.056 (gun pressures of 9, 21, and 34 psig) at 200 amperes current and 36 volts potential, spraying was discontinued by simultaneously turning off the electric power and the wire feed mechanism of the gun. The solidified wire tips were sectioned longitudinally, polished, and photographed at 15x magnification. The sections then were etched with ferric chloride and photographed at 30x, 50x, and 200x magnification to study the crystal structure of the solidified metal.

Analyses of these micrographs led to the following observations and conclusions:

1) At the wire/gas ratio of 0.141 (gun pressure of 9 psig), large molten areas were formed which exhibit good mutual alloying of sheath and core material, but molten droplets apparently were not easily detached and this resulted in the observed welding of the wire tips and unstable arc formation. This in turn led to a nonuniform coating with inferior hardness characteristics as determined from measurements earlier described.
2) At the wire/gas ratio of 0.080 (gun pressure of 34 psig), mutual alloying of the sheath and core materials did not occur uniformly because, it is believed, the high gas velocity apparently prevented enough time for droplet growth and uniform dissolution of all materials at the wire tip. Very fine droplets apparently were quickly detached, but since these droplets were not uniform in composition, the resulting coating was not uniform in hardness and chemical properties.
3) Overheating of the wire tips occurred at the wire/gas ratio of 0.141 (gun pressure of 9 psig) because droplets apparently grew larger and detached at a low rate. It is believed that a partial melting and fragmentation of solid pieces from the wire tips occurred because an excessive detachment rate of droplets decreased the amount of melting and allowed the electric arc to fracture the sheath material. Arc spitting, which is an undesirable irregularity in arcing and wire melting which results in detachment of pieces of unmelted wire material, was observed during operation at the wire/gas ratio of 0.056 (34 psig gun pressure).
4) Large austenite grain size in solidified sheath material was observed at the wire/gas ratios of 0.141 and 0.056 (gun pressures of 9 and 34 psig), indicating localized prolonged overheating and absence of desired melting, with a more desirable smaller and uniform drain size occurring at the wire/gas ratio of 0.080 (21 psig gun pressure) This indicated that heat from the arc is properly directed in droplet formation at the wire/-gas ratio of 0.080 (21 psig gun pressure) but not at wire/gas ratios of 0.141 and 0.05 (9 and 34 psig gun pressure).

EXAMPLE 5

Four of the coatings produced in Example 1 at wire/-gas ratios of 0.056, 0.080, and 0.141 using nitrogen and a ratio of 0.071 using air were additionally etched with ferric chloride and metallographically examined. The resulting micrographs are shown in FIGS. 10, 11, and 12 for coatings sprayed with nitrogen at wire/gas ratios of 0.141, 0.080, and 0.056 respectively (gun pressures of 9, 21, and 34 psig). FIG. 13 shows the micrograph for the coating sprayed with air at 21 psig gun pressure (wire/gas ratio of 0.071). These micrographs lead to the following observations and conclusions:

1) The air-sprayed coating using air with a wire/gas ratio of 0.071 was excessively oxidized with thick oxide stringers on the boundaries of the deposit particles, which is an indication of reduced coating ductility, chromium and boron depletion in the metal matrix, and reduced wear and corrosion resistance.
2) The coating formed by nitrogen spraying at a wire/-gas ratio of 0.141 (gun pressure of 9 psig) contained a large fraction of pores and round particles which were frozen in flight before deposition, and showed an overall coarse structure indicating low toughness.
3) The coatings formed by nitrogen spraying at wire/-gas ratios of 0.080 and 0.056 (gun pressures of 21 and 34 psig) revealed a uniform microstructure with little porosity or frozen particles. The coating formed using a wire/ gas ratio of 0.080 in particular contained a well-balanced mix of larger and smaller splat particles, which indicates that the particles were still molten when striking the coating surface. This also suggests a good recovery of alloy components and low oxygen and nitrogen pickup during flight.

EXAMPLE 6

Data obtained in Example 1 were analyzed to determine the effect of atomizing gas type on wire feed rate and wire/gas ratio. In the specific tests of interest, wire was sprayed at constant voltage (35 volts) and current (200 amperes) for air and nitrogen at gun pressures of 9, 21, and 34 psig. Gas flow rates were dependent upon gas type and pressure for the 0.37 inch diameter nozzle orifice used on the arc spray gun. Wire feed rates were set for each different gas to give a constant current to the gun. Wire feed rates were determined by weighing the wire supply reels before and after each test. The results are given in Table 5.

TABLE 5

Wire Feed Rates and Wire/Gas Ratios Air and Nitrogen

| | Mass Flow Rate, lb/hr | | Wire Feed Rate, lb/hr | | Wire to Gas Ratio | |
|---|---|---|---|---|---|---|
| Gun Pressure, psig | $N_2$ | Air | $N_2$ | Air | $N_2$ | Air |
| 9 | 139.7 | 145.5 | 19.7 | 18.1 | 0.141 | 0.124 |
| 21 | 245.5 | 255.5 | 19.7 | 18.1 | 0.080 | 0.071 |
| 34 | 351.4 | 366.0 | 19.7 | 18.1 | 0.056 | 0.049 |

This analysis yields the unexpected result that a higher wire feed rate is needed to maintain a constant current when nitrogen is used than when air is used. While the reasons for this phenomenon are not fully understood, it is believed that differences between nitrogen and air in gas ionization and heat transfer properties, as well as the differing degrees of chemical reaction of oxygen and nitrogen with the wire components, cause this behavior. This result means that a higher coating productivity can be achieved at a given gun power input with nitrogen than with air. The wire/gas ratios for nitrogen and air differ because of the difference in wire feed rate as well as the difference in gas flow rates for each constant gun pressure.

EXAMPLE 7

Additional arc spray tests using the same arc spray gun and cored wire of Example 1 were carried out to determine the effect of gas type on metal deposit efficiency. A 12 inch by 8 inch steel panel was grit-blasted and sprayed at constant spray gun conditions of 35 volts potential, 180–200 amperes current, and 21 psig gun pressure using air, nitrogen, and argon. Each test was carried out at a standoff distance of 5 inches using a gun traverse speed of 300 inches/minute with a 4.0 inch gun travel to the left and right of the center of the panel. This panel size and gun traverse speed were selected to ensure that all sprayed material was deposited on the panel. Wire was fed at a rate sufficient to maintain a constant gun current, and spraying was done continuously over a time period of two minutes. Wire spray rate and coating deposition rate were determined by weighing the arc spray gun wire reels and the steel panel before and after spraying. The deposit efficiency is defined as (coating deposition rate)/(wire spray rate) x 100. The results of these tests are given in Table 6.

TABLE 6

Effect of Atomizing Gas on Spray Rate and Deposit Efficiency

| Atomizing Gas | Wire Spray Rate, g/min | Coating Deposit Rate, g/min | Deposit Efficiency, % |
|---|---|---|---|
| Air | 136.7 | 90.6 | 66.3 |
| Nitrogen | 149.2 | 102.3 | 68.6 |
| Argon | 135.7 | 93.7 | 69.0 |

The results indicate that for a constant gun power input and other gun condition, nitrogen gives the highest wire spray rate while argon gives the highest deposit efficiency. The wire spray rate and deposit efficiency for air were significantly lower than those for the two inert gases.

EXAMPLE 8

The effect of atomizing gas type and pressure on deposition temperature were determined by using the wire and gun of Example 1 to coat 1.25 inch diameter steel slugs. Nitrogen and air were used for atomization at gun pressures of 9, 21, and 34 psig. A thermocouple was placed 1/16 inch below the surface of each steel slug to measure the temperature immediately before and after spraying. A potential of 38 volts was applied to the gun, and the wire rate was set to keep a constant current draw by the gun of 200 amperes. A standoff distance of 4.5 inches and a traverse speed of 300 inches/minute were used. Either four or five horizontal passes were made for each coating; the results of these coating tests are given in Table 7.

TABLE 7

Effect of Gas Type and Pressure on Arc Sprayed Deposition Temperatures

| | Atomizing Gas | | | | | |
|---|---|---|---|---|---|---|
| | Air | | | Nitrogen | | |
| | Gun Pressure, psig | | | | | |
| | 9 | 21 | 34 | 9 | 21 | 34 |
| No. of Gun Passes | 4 | 4 | 5 | 4 | 4 | 4 |
| Total Deposit Thickness, $10^{-3}$ inches | 29 | 20 | 27 | 31 | 27 | 28 |
| Thickness Per Pass, $10^{-3}$ inches | 7.25 | 5.00 | 5.40 | 7.75 | 6.75 | 7.00 |
| Total Deposit Weight, grams | 2.65 | 1.85 | 2.68 | 2.66 | 2.17 | 2.62 |
| Weight per Pass, grams | 0.661 | 0.462 | 0.537 | 0.666 | 0.542 | 0.654 |
| Initial Substrate Temperature, °C. | 28 | 24 | 26 | 24 | 22 | 24 |
| Final Substrate Temperature, °C. | 138 | 114 | 128 | 138 | 120 | 104 |
| Unit Substrate Temperature Increase, °C./$10^{-3}$ inches | 3.79 | 4.50 | 3.78 | 3.68 | 3.63 | 2.86 |
| Unit Substrate Temperature Increase, °C./gram deposit | 41.6 | 48.7 | 38.0 | 42.8 | 45.2 | 30.6 |

It can be seen from Table 7 that the coating deposition rate (shown in terms of thickness per pass and weight per pass) is greater with nitrogen atomization than with air atomization at constant gun operating conditions, which confirms the observations made in Examples 6 and 7. The increase in substrate temperature per unit thickness of deposited coating is significantly lower when nitrogen is used than when air is used for atomization, and the increase in substrate temperature per unit weight of deposited coating is lower when nitrogen is used at the gun pressures of 21 and 34 psig. These are important and unexpected findings which indicate that the molten droplets during flight from the arc spray gun to the substrate cool faster when nitrogen is used for atomization than when air is used, and therefore exhibit a higher quench rate. This is important because the higher quench rate causes the formation of a higher fraction of desirable amorphous structure in the metal coating, which in turn results in a harder, more wear-resistant coating. The higher quench rates observed here are consistent with the results of Example 3 in which x-ray diffraction analysis showed a higher fraction of amorphous structure in nitrogen-sprayed coatings than in air-sprayed coatings.

The present invention thus allows the optimized application of hard, wear resistant coatings to substrates by the efficient and economical arc spraying of cored wire. In contrast with methods to reduce oxidation of sprayed components described in the background art, the present invention utilizes inert gas for atomization to reduce or eliminate such oxidation. It has been found that the use of nitrogen in place of air which is typically used for atomization in arc spraying unexpectedly increases the wire feed rate at constant arc spray gun operating conditions, which allows a higher coating deposition rate for a given gun power input. In addition, the use of nitrogen rather than air yields a higher molten droplet quench rate which in turn produces a harder, more wear-resistant coating. Further, a preferred range of wire/gas ratios between about 0.07 and about 0.11 is defined in the present invention whereby an optimum combination of coating hardness properties and arc spray gun operating characteristics is realized. This range of wire/gas ratios is not predictable from the background art of arc spraying of cored wires.

The essential characteristics of the present invention are described fully and completely in the foregoing disclosure, from which one skilled in the art can understand the invention and make various changes and modifications thereto without departing from the basic spirit and scope thereof.

We claim:

1. A method for applying a metallic coating to a substrate by electric arc spraying of cored wire comprising:

(a) forming an electric arc between two metallic wires in an arc spray gun, wherein at least one of said wires is a cored wire comprising a powder-filled metallic sheath, thereby forming molten material; and (b) directing inert gas across said arc to form molten droplets and propel said droplets onto said substrate to solidify and form said metallic coating, wherein the mass ratio of the wire feed rate to the inert gas feed rate is between about 0.055 and about 0.15;

whereby the operation of said arc spray gun at said mass ratio between about 0.055 and about 0.15 maximizes the microhardness of said metallic coating.

2. The method of claim 1 wherein said inert gas is selected from the group consisting of argon, nitrogen, and mixtures thereof.

3. The method of claim 1 wherein said power-filled metallic sheath contains powder material selected from the group consisting of cobalt, nickel, chromium, boron, iron, molybdenum, copper, manganese, carbon, silicon, phosphorous, aluminum, tungsten carbide, boron carbide, and alloys or mixtures thereof.

4. The method of claim 3 wherein the material of said metallic sheath comprises metal selected from the group consisting of iron, nickel, aluminum, and alloys or mixtures thereof.

5. The method of claim 1 wherein the gun pressure of said inert gas is between about 7 psig and about 35 psig.

6. A method for applying a metallic coating to a substrate by electric arc spraying of cored wire comprising:

(a) forming an electric arc between two metallic wires in an arc spray gun, wherein at least one of said wires is a cored wire comprising a power-filled metallic sheath, thereby forming molten material; and (b) directing inert gas across said arc to form molten droplets and propel said droplets onto said substrate to solidify and form said metallic coating, wherein the mass ratio of the wire feed rate to the inert gas feed rate is between about 0.07 and about 0.11;

whereby the operation of said arc spray gun at said mass ratio between about 0.07 and about 0.11 maximizes the microhardness of said metallic coating.

7. The method of claim 6 wherein said inert gas is selected from the group consisting of argon, nitrogen, and mixtures thereof.

8. The method of claim 6 wherein said powder-filled metallic sheath contains powder material selected from the group consisting of cobalt, nickel, chromium, boron, iron, molybdenum, copper, manganese, carbon, silicon, phosphorous, aluminum, tungsten carbide, boron carbide, and alloys or mixtures thereof.

9. The method of claim 8 wherein the material of said metallic sheath comprises metal selected from the group consisting of iron, nickel, aluminum, and alloys or mixtures thereof.

10. The method of claim 6 wherein one of said wires is a cored wire and one is a solid wire.

11. The method of claim 6 wherein both of said wires are cored wires.

12. The method of claim 6 wherein the potential across said arc is between about 36 and about 40 volts.

13. The method of claim 6 wherein the current supplied to said arc is between about 150 and about 250 amperes.

14. The method of claim 6 wherein the gun pressure of said inert gas is between about 14 psig and about 25 psig.

15. The method of claim 6 wherein said substrate comprises metallic or ceramic materials.

* * * * *